US009583889B2

(12) United States Patent
Wu et al.

(10) Patent No.: US 9,583,889 B2
(45) Date of Patent: Feb. 28, 2017

(54) CABLE CONNECTOR ASSEMBLY HAVING IMPROVED METAL SHELL

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/941,461

(22) Filed: Nov. 13, 2015

(65) Prior Publication Data

US 2016/0141797 A1 May 19, 2016

(30) Foreign Application Priority Data

Nov. 14, 2014 (CN) ..... 2014 2 0677006 U

(51) Int. Cl.
*H01R 9/03* (2006.01)
*H01R 13/6593* (2011.01)
*H01R 24/60* (2011.01)

(52) U.S. Cl.
CPC ..... *H01R 13/6593* (2013.01); *H01R 24/60* (2013.01)

(58) Field of Classification Search
CPC . H01R 13/5845; H01R 13/6461; H01R 13/58; H01R 13/6593; H01R 24/60; H01R 24/28
USPC ..... 439/607.55
See application file for complete search history.

(56) References Cited

U.S. PATENT DOCUMENTS 9,178,319 B2 * 11/2015 Little ..... H01R 13/6585 439/607.4
2015/0050837 A1 2/2015 Wu et al.

* cited by examiner

*Primary Examiner* — Javaid Nasri
(74) *Attorney, Agent, or Firm* — Wei Te Chung; Ming Chieh Chang

(57) ABSTRACT

A cable connector assembly (100) comprising a cable (300) including a plurality of wires (31) and an electrical connector (200) electrically connected with the cable, the electrical connector including a mating member (1) and a metal shell (4), the mating member including a mating shell (14) made of metal material, the mating shell including a mating portion (141) and a mounting portion (142) having a greater dimension than the mating portion, wherein the metal shell includes a main body (43) and a pair of holding portions (44) extending from a front end of the main body, the holding portions profiling an external surface shape of the mounting portion and fixed to the mounting portion.

20 Claims, 10 Drawing Sheets

CABLE CONNECTOR ASSEMBLY HAVING IMPROVED METAL SHELL

BACKGROUND OF THE INVENTION

1. Field of the Invention

The present invention relates generally to a cable connector assembly and more particularly to an improved metal shell thereof.

2. Description of Related Arts

U.S. Patent Application Publication No. 2015/0050837, published on Feb. 19, 2015, shows a cable connector assembly including a metallic shell. The metallic shell compresses a shielding member, a front shell, and a rear shell. When assembled, an insulative housing is received in the shielding member, a tongue plate of the insulative housing is received in a receiving portion of the shielding member, and a locking portion of a locking member is exposed from a front end of the shielding member. The shielding member after assembled is received in the rear shell, and a front stopping plate of the rear shell abuts on the a front end of the insulative housing. The front shell is engaged in the rear shell along an up-to-down direction. A number of teeth of the front shell are inserted into a number of corresponding locking holes of the rear shell, and an extension plate rearwardly extended from the rear shell shields a through hole of the front shell, thus the shielding member, the rear shell, the front shell, and the insulative housing are combined together.

With the above way of combination of the metal shell, the strength of the cable connector assembly is not strong such that the connector is prone to bend under an external force.

An improved metal shell in a cable connector assembly is desired.

SUMMARY OF THE INVENTION

An object of the present invention is to provide an improved metal shell in a cable connector for improving the strength of cable connector assembly.

To achieve the above-mentioned object, a cable connector assembly comprises: a cable including a plurality of wires; and an electrical connector electrically connected with the cable, the electrical connector including a mating member and a metal shell, the mating member including a mating shell made of metal material, the mating shell including a mating portion and a mounting portion, the mounting portion having a greater dimension than the mating portion; wherein the metal shell includes a main body and a pair of holding portions extending from a front end of the main body, the holding portions profiling an external surface shape of the mounting portion and fixed to the mounting portion.

DETAILED DESCRIPTION OF THE PREFERRED EMBODIMENT

Figure 1:
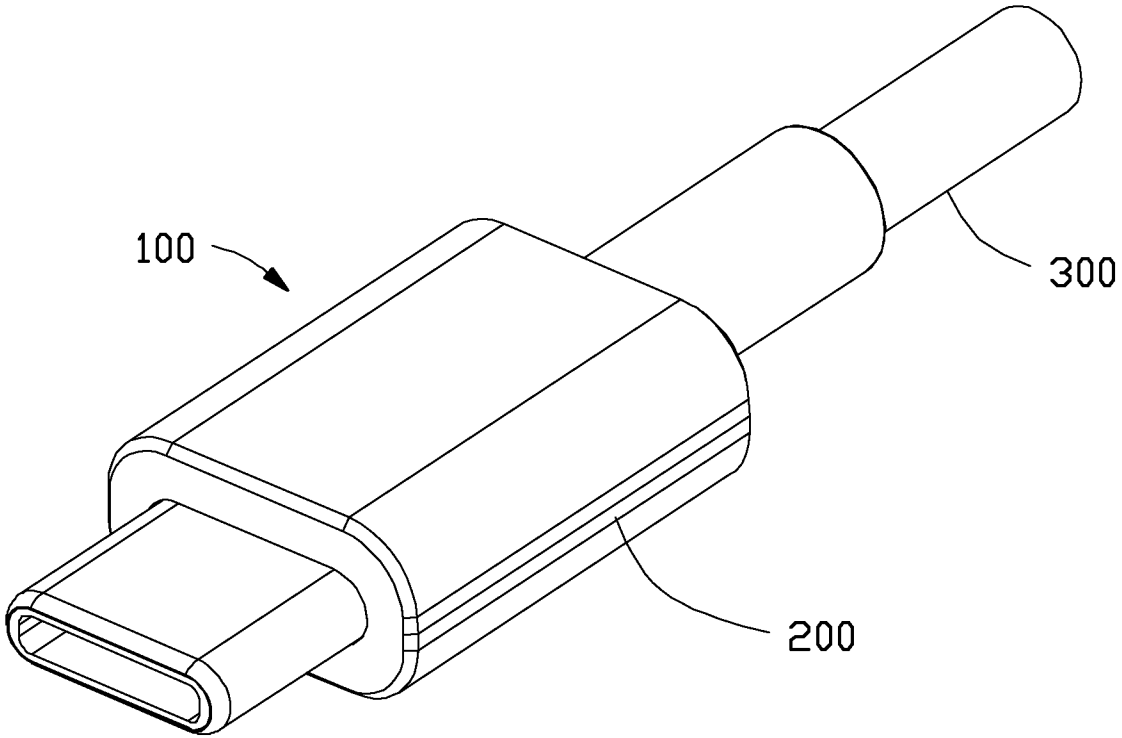
FIG. 1 is a perspective view of a cable connector assembly in accordance with the present invention.
Figure 2:
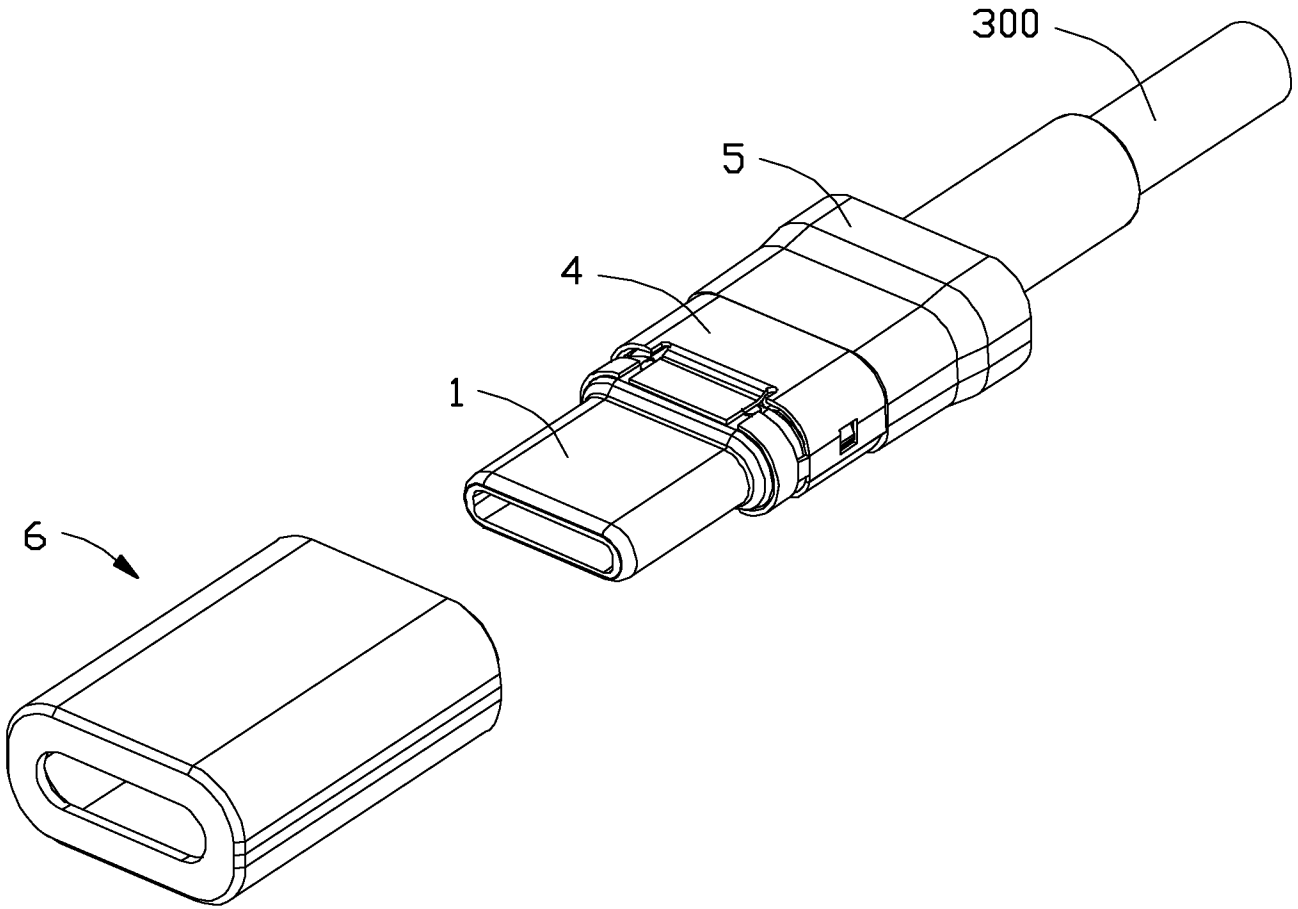
FIG. 2 is a partially exploded view of the cable connector assembly in FIG. 1.
Figure 3:
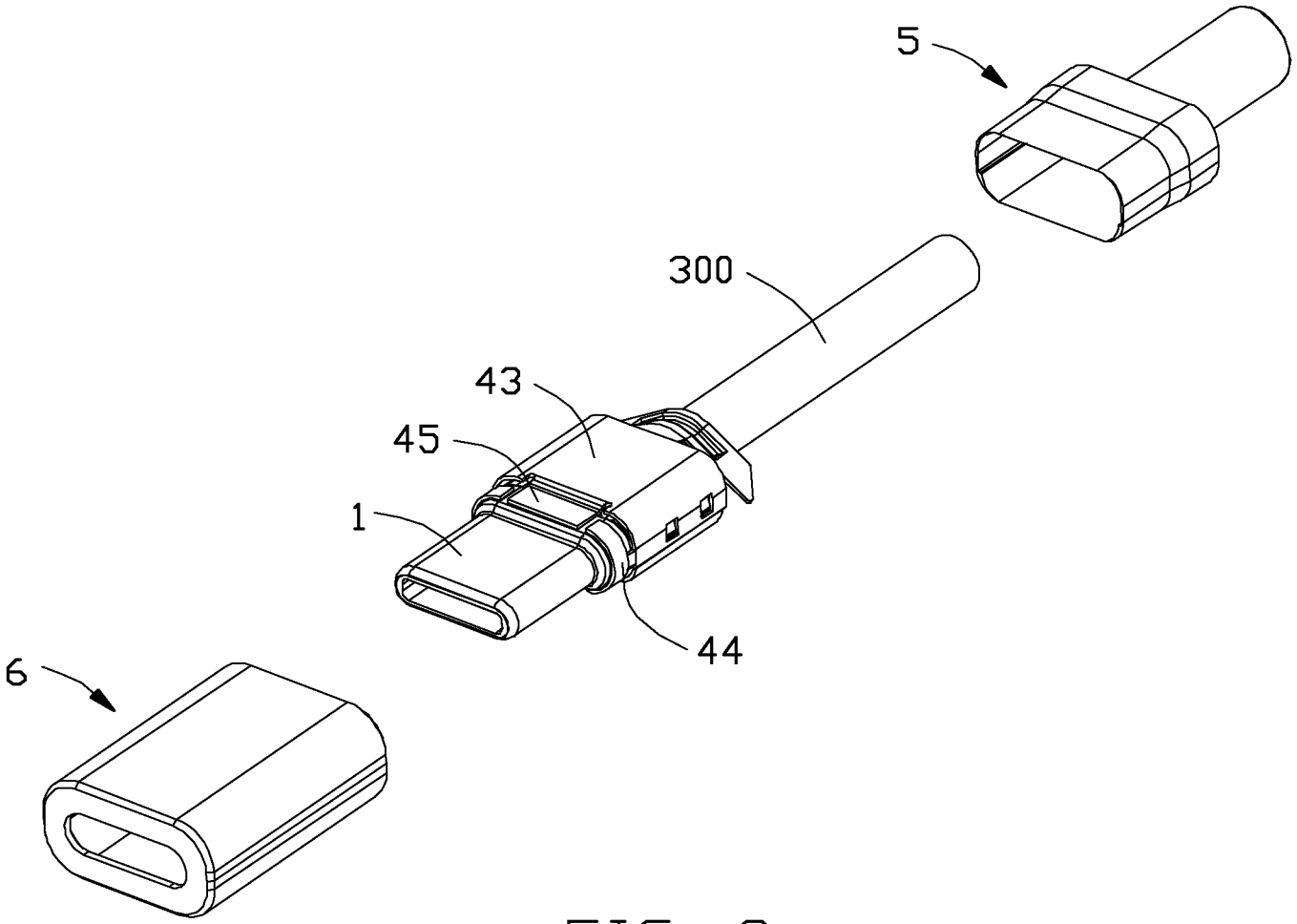
FIG. 3 is a further partially exploded view of the cable connector assembly in FIG. 2.

Referring to FIGS. 1 to 4, a cable connector assembly, e.g., a plug connector assembly 100, in accordance with the present invention for mating with a mating connector (not shown), comprises an electrical connector 200 and a cable 300 electrically connected to the electrical connector 200. The electrical connector 200 includes a mating member 1, an insulative member assembled behind the mating member 1, a metal shell 4 made of metal materials encloses the insulative member 2, a strain relief 5 molded on the metal shell 4 and a conjugation segment of the outer cable 300, and an outer shell 6 covering on the strain relief 5. The plug connector assembly 100 can be mated with the mating connector in two orientations.

Figure 9:
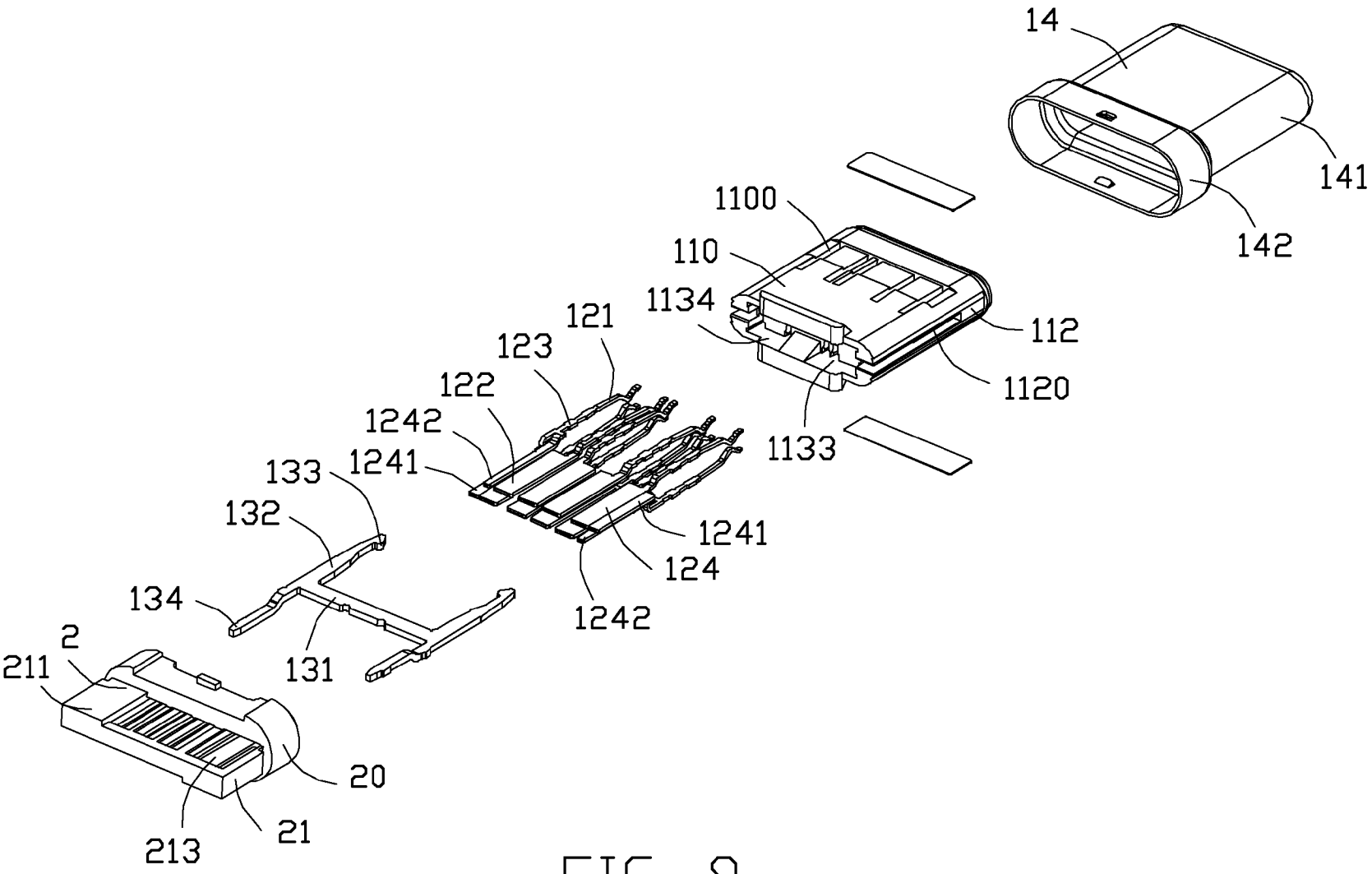
FIG. 9 is an exploded view of the mating member of the cable connector assembly in FIG. 1.
Figure 10:
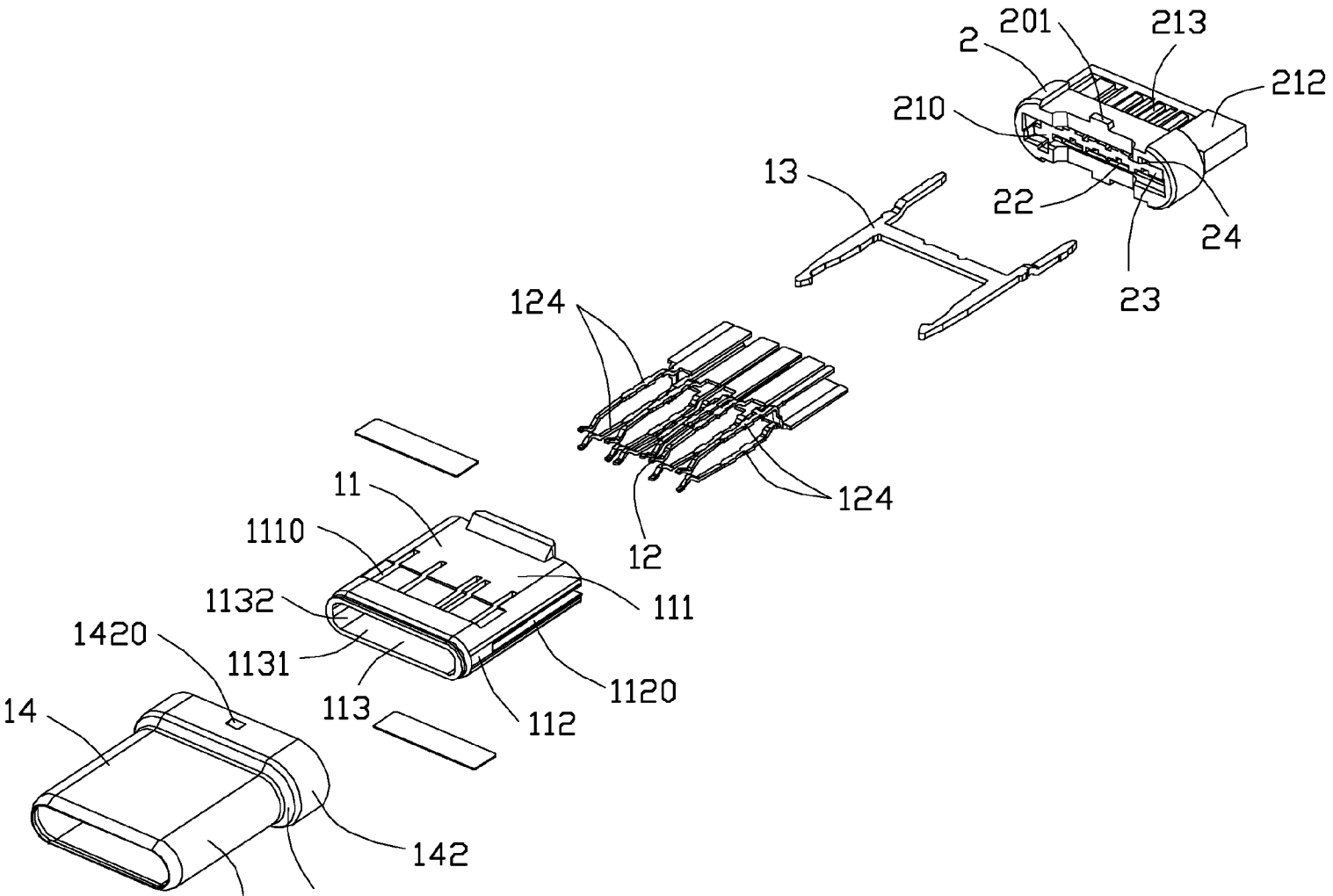
FIG. 10 is an exploded view similar to the FIG. 9, but from a different aspect.

Referring to FIGS. 9 and 10, the mating member 1 comprises an insulative housing 11, a plurality of contacts 12 arranged in two rows and spaced apart from each other in a vertical direction, a latch 13 disposed between the two rows of contacts 12 for latching with the mating connector, and a mating shell 14 covers the insulative housing 11.

The insulative housing 11 comprises a top wall 110, a bottom wall 111 spaced apart from and parallel with the top wall 110, a pair of side walls 112 parallel to each other and connecting with top wall 110 and the bottom wall 111, a receiving room 113 surround by the top, bottom, and side walls 110, 111, 112, and the receiving room 113 is divided into a front portion 1132 having a front opening 1131 and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113.

The contacts 2 are arranged in two rows and spaced apart from each other in a vertical direction. Each of the contacts 12 comprises a front mating portion 121 extending forwardly into the insulative housing 11, a rear mating portion 122 extending rearwardly, and an intermediate mounting portion 123 connected between the front mating portion 121 and the rear mating portion 122 and secured to the insulative housing 11. The front mating portion 121 is to be mated with the mating connector and the rear mating portion 122 is to be electrically mated with the cable 300. The front mating portions 121 of the two rows of contacts 12 are arranged face to face along the vertical direction. The rear mating portions 122 of the upper row of contacts 12 are arranged in a same plane, and the rear mating portions 122 of the lower row of contacts 12 are arranged in another same plane. The contacts 12 include four grounding contacts 124 arranged at both sides of the contacts 12 symmetrically. The rear mating portion of 122 of each grounding contact 124 includes a first rear mating portion 1241 and a second rear mating portion 1242. The first rear mating portions 1241 of the grounding contacts 124 in the upper row are downwardly bent to be arranged in a same plane with the first rear mating portions 1241 of the grounding contacts 124 in the lower row. The second mating portions 1242 of the grounding contacts 124 is arranged in the same plane with the rear mating portions of the other contacts 12 in the upper row. The first rear mating portions 1241 of the grounding contacts 124 in the lower row is upwardly bent to be arranged in the same plane with the first rear mating portions 1241 of the grounding contacts 124 in the upper row, and the second rear mating portions 1422 of the grounding contacts 124 in the lower row in arranged in a same plane with the rear mating portions 122 of other contacts 12 in the lower row.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction, and a pair of extension arms 134 respectively extending rearwardly from the two opposite ends of the base portion 131. An extension arm 134 on one side is in a lower plane relative to a plane the base portion 131 located, and another extension arm 134 on another side is in a higher plane relative to the plane the base portion 131 located. The latch 13 is mounted into the insulative housing 11 through the rear opening 1133 of the rear portion 1134 of the receiving room 113 along a rear-to-front direction. The latch beams 132 are received into the side recesses 1120, respectively. At least a portion of the latch portions 133 projects into the front portion 1132 of the receiving room 113.

The mating shell 14 has a closed circumference that has a good seal performance, a good anti-EMI performance, etc. The closed circumference of the mating shell 14 could be manufactured by drawing a metal piece, bending a metal piece, casting metal materials, etc. The mating shell 14 comprises a front end 141 for being inserted into the mating connector, a rear end 142 with a larger size than the front end 141, and a third transition portion 143 for connecting to the front end 141 and the rear end 142. The shape of the rear end 142 is consistent with the insulative member 2. A diametrical dimension of the front end 141 is smaller than a diametrical dimension of the rear end 142. The rear end 142 comprises a pair of latch tabs 1420 projecting outwardly.

The insulative member 2 provides fixation for latch 13 together with the insulative housing 11. The insulative member 2 includes a base portion 20, a extending portion 21 rearwardly extended from the base portion 20, a number of through holes 22 defined through the base portion 20 and arranged in two rows and spaced apart from each other in a vertical direction, a receiving slot 23 defined between the tow row through holes 22 and communicating with the through holes 22, and a number of receiving holes 24 side by side defined with the through holes 22. Each side of the extending portion 21 defines a mounting slot 210 communicating with the receiving slot 23 thereof. The insulative member 2 is assembled to the insulative housing 11 along a rear-to-front direction, the contacts 12 is inserted into the corresponding through holes 22, the base portion 131 of the latch 13 is received in the receiving slot 23, the pair of the extension arms 134 is extended into the corresponding mounting slot 210, the second rear mating portion 1242 of the grounding contacts 124 is received in the corresponding receiving slots 24. The extending portion 21 of the insulative member 2 defines a top sidewall 211 and an opposite bottom sidewall 212. A number of accommodating grooves 213 are defined on both the top sidewall 211 and the bottom sidewall 212 for accommodating the rear mating portion 122 of the contacts 12. The rear mating portion 122 of the contacts 12 are exposed from a rear end of the corresponding though holes 22 and further received in the corresponding receiving slots 213 to be connected with the cable 300. The extension arms 134 of the latch 13 are exposed from the corresponding mounting slots 210 and than located on the top sidewall 211 and the second sidewall 212. The structure of the top sidewall 211 is centrosymmetric relative to the bottom sidewall 212. A number of projections 201 are defined on the base portion 20 of the insulative member 2 to be fixed with the latch tabs 1420 of the mating member 2.

The cable 300 has a number of wires 31 and a sheath 32 that contains the wires 30, the wires 31 are connected with the corresponding rear mating portion 122 of the contacts 12.

Figure 4:
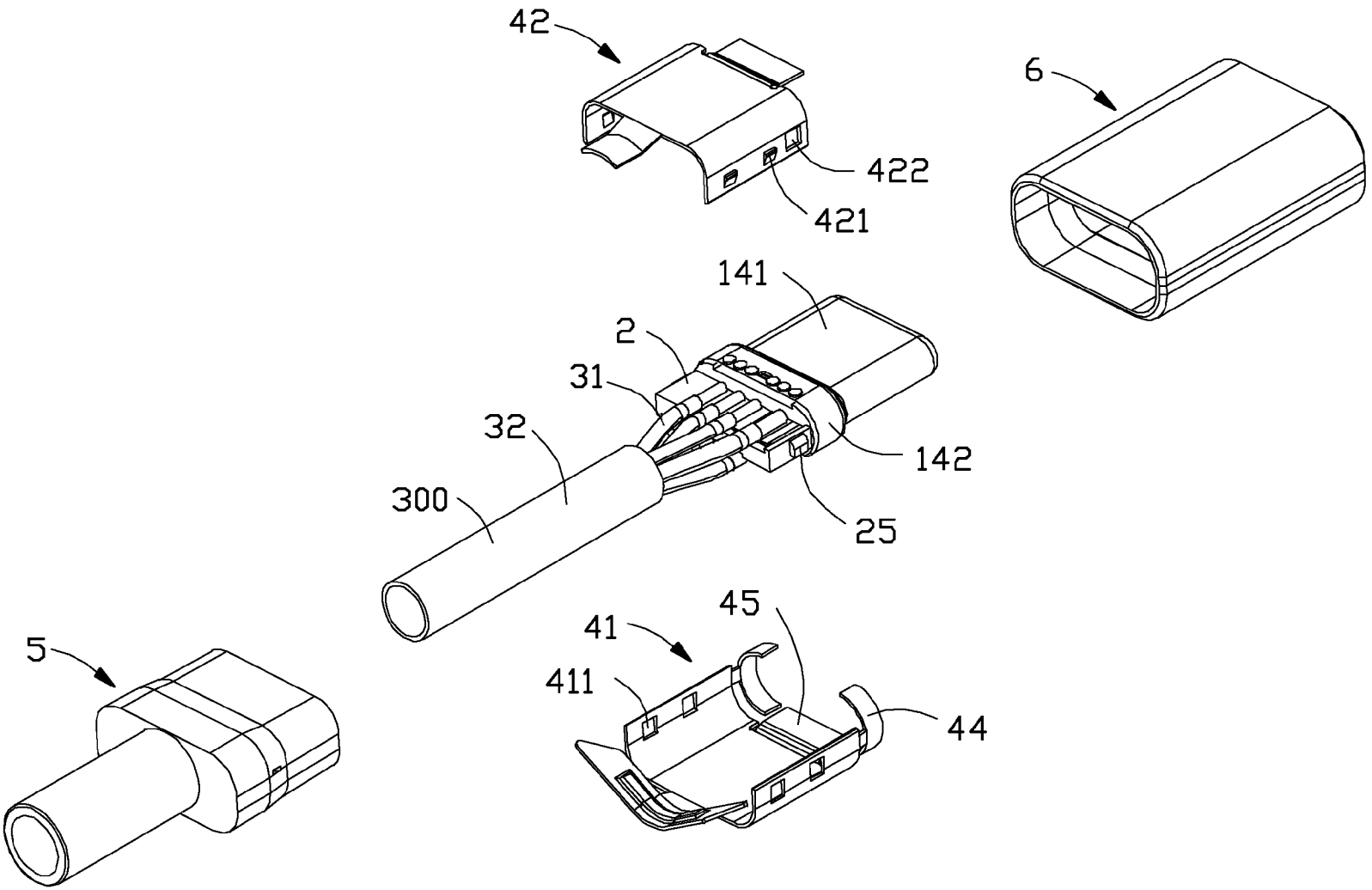
FIG. 4 is a partially exploded view of the cable connector assembly in accordance with a first embodiment of the present invention.
Figure 5:
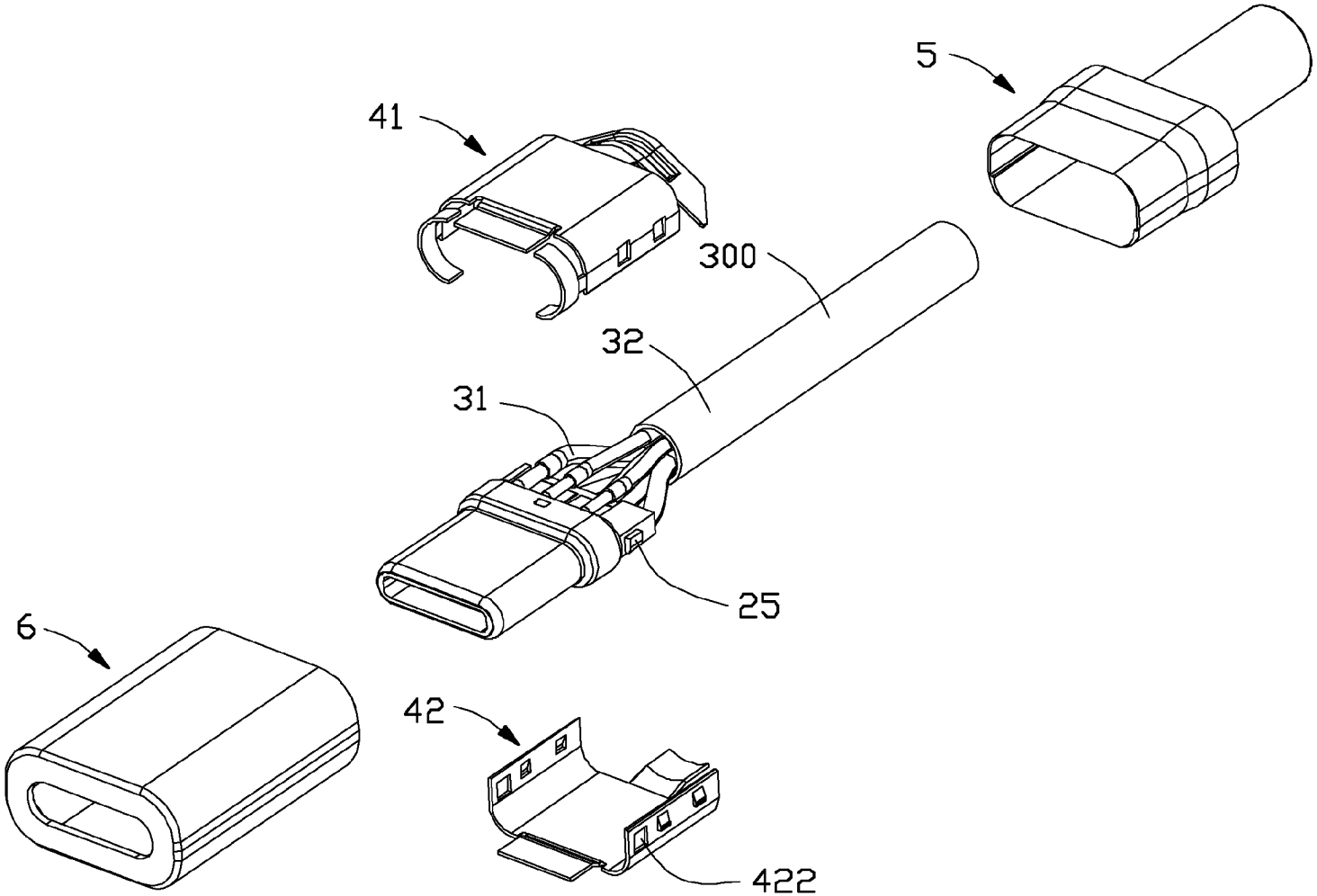
FIG. 5 is a partially exploded view similar to the FIG. 4, but from a different aspect.

Referring particularly to FIGS. 4 and 5, the metal shell 4 includes a first shell 41 and a second shell 42 engaged with the first shell 41. A main body 43 and two holding portions 44 respectively extending from the two opposite sides of the main body 43 to consistent with the surface shape of the mounting portion 142 of the mating shell 14 are formed after the engagement of the first and second shell 41,42. The holding portion 44 is an elastic sheet bent of a curved shape, and an opening of the pair of holding portions 44 are arranged face to face, the inside wall of the holding portion 44 fits the surface of the mounting portion 142. In present embodiment, the holding portions 44 are soldered with the mouthing portion 142 to be firmly fixed. In other embodiments, the holding portions 44 can be fixed with the mounting portion 142 by plastic or other means, etc. The holding portions 44 are formed on the first shell 41. Both of the first shell 41 and the second shell 42 include a tongue sheet 45 extending from a front end of the main body 43, the tongue sheets 45 are located between the two holding portions 44 and arranged face to face. The pair of tongue sheets 45 is against the top and bottom surface of the mounting portion 142 respectively and soldered on the mounting portion 142 to be further fixed. A number of holding holes 411 are defined on the both sides of the first shell 41. A number of fixing elastic sheets 421 forming on the both sides of the second shell 42 are fixed in the corresponding holding holes 411 in order to fix the first shell 41 with the second shell 42.

Figure 6:
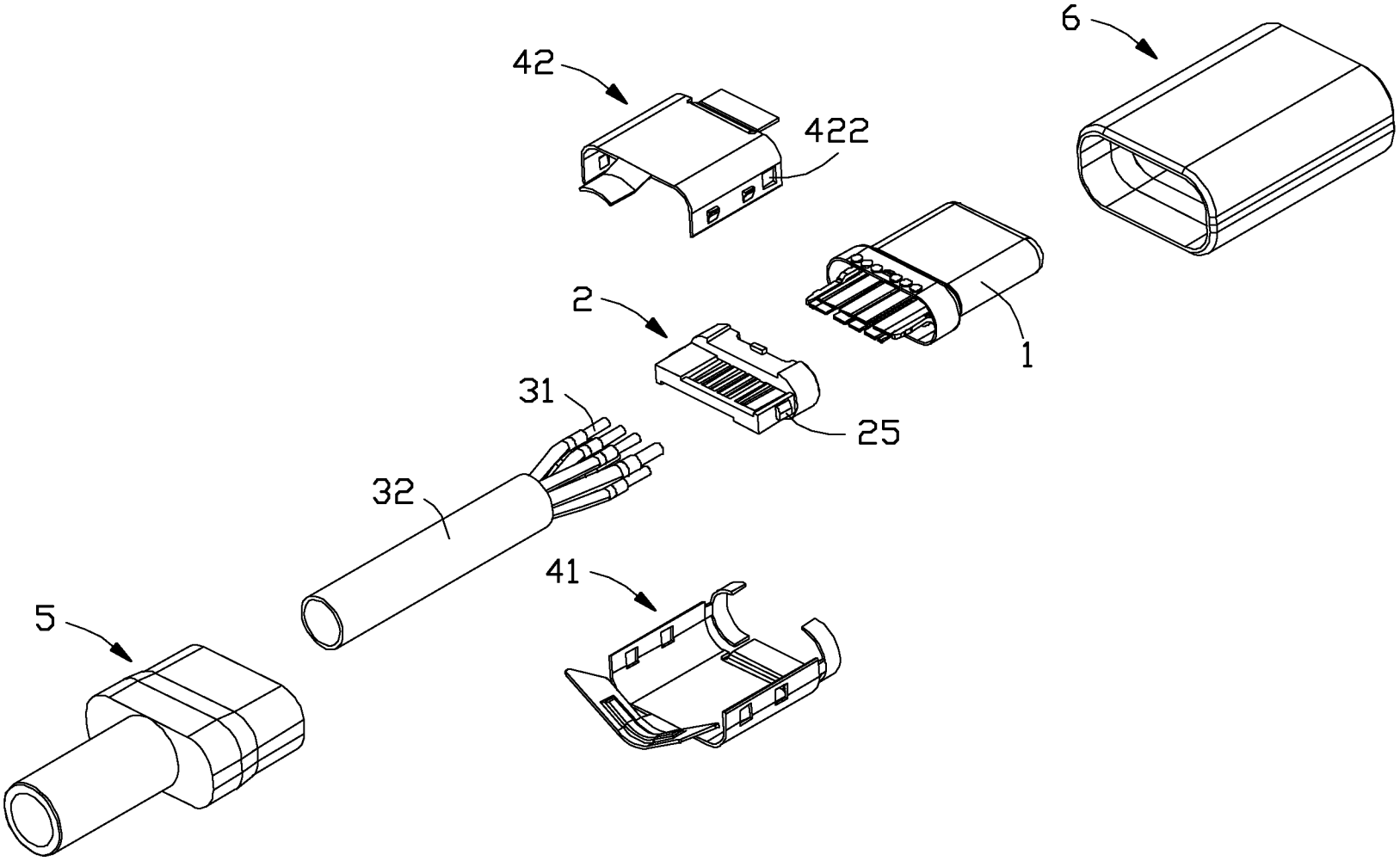
FIG. 6 is an exploded view of the cable connector assembly in FIG. 4, not including the mating member.
Figure 7:
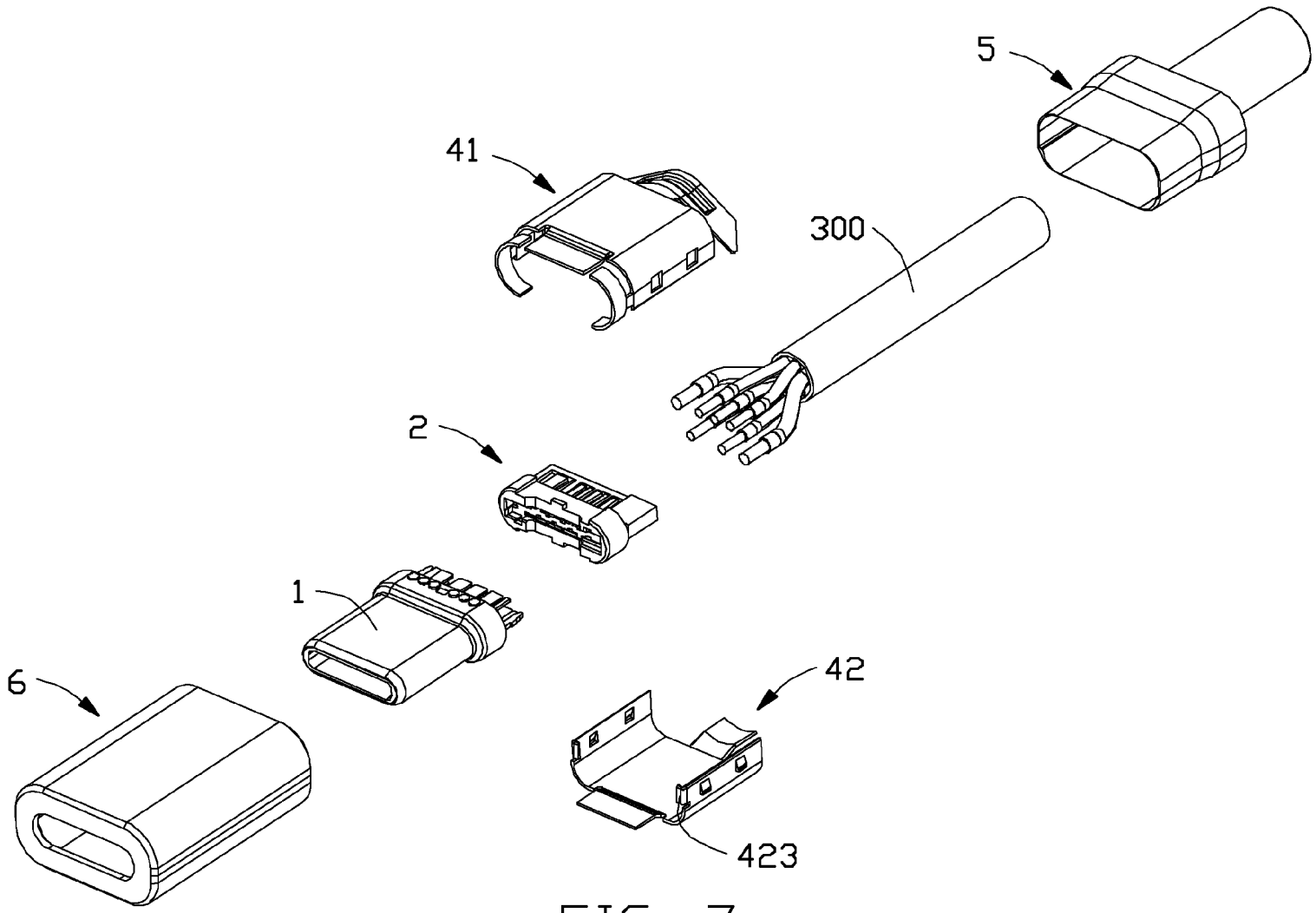
FIG. 7 is an exploded view of the cable connector assembly in accordance with a second embodiment of the present invention, not including the mating member.
Figure 8:
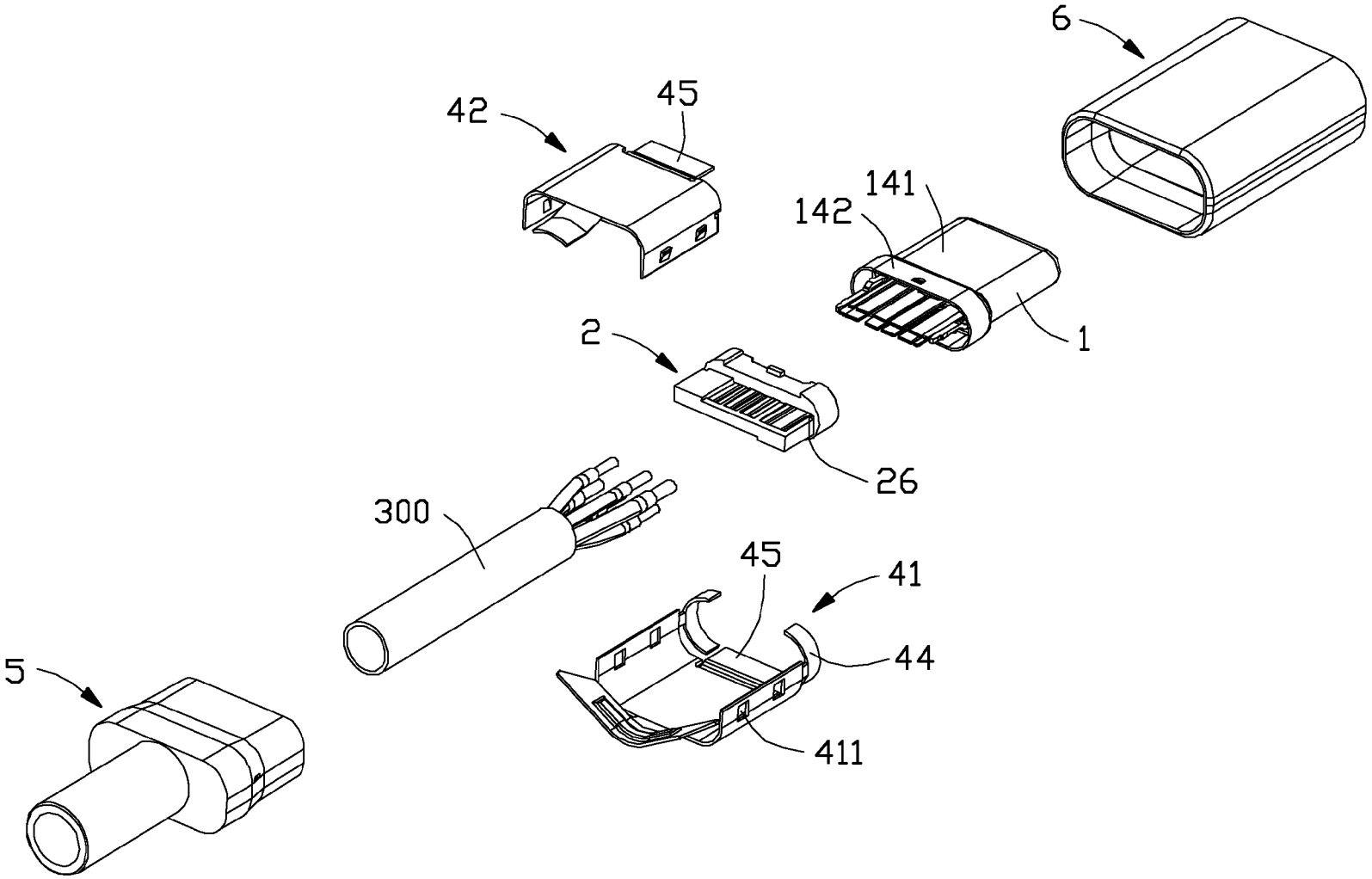
FIG. 8 is an exploded view similar to the FIG. 7, but from a different aspect.

Referring particularly to FIGS. 4 and 6, in a first embodiment in accordance with the present invention, a convex block 25 is defined on a side of the insulative member 2 and a fixing hole 422 is defined on the second shell 42 to fix the convex block 25 so that the metal shell 4 is fixed on the insulative member 2. Referring particularly to FIGS. 7 and 8, in a second embodiment in accordance with the present invention, a pair of fixing slot 26 are defined on both sides of the insulative member 2 and a pair of bent sheet 423 are extended on corresponding positions of the second shell 42 to engaged in the corresponding fixing slots 26 so that the metal shell 4 is fixed on the insulative member 2. The pair of fixing slots 26 are defined between the base portion 20 and the extending portion 21 of the insulative member 2, and the bent sheet 423 are defined on two sides of a front end of the second shell 42.

In assembling the cable connector assembly 100, firstly, the contacts 12 and the latch 13 are inserted into the insulative housing 11, and then the insulative housing 11 is received in the mating shell 14, and the insulative member 2 is received in the mounting portion 142 of the mating shell 14. The rear mating portion of the contacts 12 received in the mating member 1 is then passed through the corresponding through holes 22 of the insulative member 2 and received in corresponding accommodating grooves 213 thereof. The extension arms 134 of the latch 13 are passed through the mounting slot 210 and located on the top sidewall 211 and the bottom sidewall 212 of the insulative member 2. The extension arms 134 of the latch are soldered or pasted on the top sidewall 211 and the bottom sidewall 212. The wires 31 of the cable 300 are soldered on the corresponding rear mating portions 122 and the two first rear mating portion 1241 of the grounding contacts 124 are soldered on a wire 31. The first shell 41 is enclosed on the mating member 1 and the insulative member 2 and the holding portions 44 are against the mounting portion 142 of the mating shell 14. The second shell 42 are engaged on the first shell 41 from a top-to-bottom direction and the convex block 25 is received in the fixing hole 422 of the second shell 42. In the second embodiment, the bent sheets 423 of the second shell 42 are received in corresponding fixing slots 26. The holding portion 44 are soldered on the mounting portion 142 of the mating shell 14. The tongue sheet 45 is soldered on the mounting portion 142 of the mating shell 14. The strain relief 5 is molded on at least a portion of the metal shell 4 and the cable 300. The outer shell 6 is molded or mounted on the metal shell 4 and the strain relief 6 and fixed by glues.

What is claimed is:

1. A cable connector assembly comprising:

a cable including a plurality of wires; and an electrical connector electrically connected with the cable, the electrical connector including a mating member and a metal shell, the mating member including a mating shell made of metal material, the mating shell including a mating portion and a mounting portion, the mounting portion having a greater dimension than the mating portion; wherein the metal shell includes a main body and a pair of holding portions extending from a front end of the main body, the holding portions profiling an external surface shape of the mounting portion and fixed to the mounting portion.

2. The cable connector assembly as claimed in claim 1, wherein the holding portions are soldered on the mounting portion.

3. The cable connector assembly as claimed in claim 1, wherein the holding portion is an elastic sheet bent into a curved shape, an opening of the pair of holding portions are arranged face to face, and an inside wall of the holding portion fits the surface of the mounting portion.

4. The cable connector assembly as claimed in claim 3, wherein a pair of tongue sheets forwardly extend from a front end of the main body and are arranged face to face between the pair of holding portions, the pair of tongue sheets bearing against a top surface and a bottom surface of the mounting portion.

5. The cable connector assembly as claimed in claim 4, wherein the tongue sheets are soldered on the mounting portion.

6. The cable connector assembly as claimed in claim 4, wherein:

the metal shell includes a first shell and a second shell engaged with the first shell;

the holding portion is extended from the first shell; and the pair of tongue sheet are respectively extended from the main body of both the first and second shells.

7. The cable connector assembly as claimed in claim 6, wherein a plurality of holding holes are defined on the first shell, and a plurality of fixing elastic sheets are extended on the second shell to be fixed in corresponding holding holes.

8. The cable connector assembly as claimed in claim 6, further including an insulative member assembled on a rear end of the mating member and enclosed in the metal shell.

9. The cable connector assembly as claimed in claim 8, wherein a convex block is defined on a side of the insulative member, a fixing hole is defined on a corresponding position of the second shell, and the convex block is received and fixed in the fixing hole to fix the metal shell on the insulative member.

10. The cable connector assembly as claimed in claim 8, wherein a fixing slot is defined on the side of the insulative member and a bent sheet is extended on the corresponding position of the second shell and received in corresponding fixing slot to fix the metal shell on the insulative member.

11. A cable connector assembly comprising:

an insulative housing forming a mating cavity forwardly communicating with an exterior along a front-to-back direction;

a plurality of contacts disposed in the housing, each of said contacts defining a front contacting section and a rear soldering section;

an insulative spacer located behind the housing with the soldering sections exposed thereupon;

a metallic front shell enclosing the housing and forming a tubular configuration extending along said front-to-back direction in a seamless manner, said front shell defining a capsular cross-sectional configuration viewed along said front-to-back direction; and a metallic rear shell having a front region overlapped with a rear region of the front shell with a range along said front-to-back direction, and having a first half and a second half assembled to each other in a vertical direction perpendicular to the front-to-back direction, at least one of the first half and the second half secured to the spacer, the first half and the second half secured to each other; and at least one of said first half and said second half soldered to the rear region of the front shell.

12. The cable connector assembly as claimed in claim 11, wherein a solder area between the front shell and the rear shell is located on a long horizontal side of said capsular configuration.

13. The cable connector assembly as claimed in claim 11, wherein said rear shell includes a pair of holding portions intimately and compliantly abutting against upon two opposite short sides of the capsular configuration.

14. The cable connector assembly as claimed in claim 13, wherein said pair of holding portions extend forwardly from two opposite lateral sides of the rear shell, respectively.

15. The cable connector assembly as claimed in claim 11, wherein the front shell is made by deep drawing process while the rear shell are made by stamped and bent.

16. The cable connector assembly as claimed in claim 11, wherein said first half and said second half are secured to each other by an elastic tang engaged within a holding hole.

17. A cable connector assembly comprising:

an insulative housing forming a mating cavity forwardly communicating with an exterior along a front-to-back direction;

a plurality of contacts disposed in the housing, each of said contacts defining a front contacting section and a rear soldering section;

a metallic front shell enclosing the housing and forming a tubular configuration extending along said front-to-back direction in a seamless manner, said front shell defining a capsular cross-sectional configuration viewed along said front-to-back direction; and a metallic rear shell having a front region overlapped with a rear region of the front shell with a range along said front-to-back direction, and having a first half and a second half assembled to each other in a vertical direction perpendicular to the front-to-back direction, the first half and the second half secured to each other; and at least one of said first half and said second half soldered to the rear region of the front shell on an area formed on a long side of said capsular cross-sectional configuration, and the rear shell further including a pair of holding portions sandwiching said front shell therebetween in a transverse direction perpendicular to both said front-to-back direction and said vertical direction.

18. The cable connector assembly as claimed in claim 17, wherein said pair of holding portions extend from two opposite lateral sides of a main body of the rear shell.

19. The cable connector assembly as claimed in claim 18, wherein both said first half and said second half have corresponding tangs respectively soldered upon two opposite long sides of the capsular cross-sectional configuration.

20. The cable connector assembly as claimed in claim 19, further including an insulative spacer located behind the housing with rear soldering sections exposed thereon, wherein the rear shell encloses the spacer.

* * * * *